US007089093B2

(12) United States Patent
Lacote et al.

(10) Patent No.: US 7,089,093 B2
(45) Date of Patent: Aug. 8, 2006

(54) METHOD AND APPARATUS FOR CONTROLLING TRAINS, IN PARTICULAR A METHOD AND APPARATUS OF THE ERTMS TYPE

(75) Inventors: François Lacote, St Ouen (FR); Philippe Michaut, St Ouen (FR)

(73) Assignee: Alstom, Paris (FR)

( * ) Notice: Subject to any disclaimer, the term of this patent is extended or adjusted under 35 U.S.C. 154(b) by 250 days.

(21) Appl. No.: 10/855,647

(22) Filed: May 28, 2004

(65) Prior Publication Data

US 2004/0267415 A1 Dec. 30, 2004

(30) Foreign Application Priority Data

Jun. 27, 2003 (FR) ..... 03 07835

(51) Int. Cl.

| | |
|---|---|
| ***G06F 7/00*** | (2006.01) |
| ***G06F 17/00*** | (2006.01) |
| ***G05D 1/00*** | (2006.01) |
| ***B61L 27/04*** | (2006.01) |

(52) U.S. Cl. ..... 701/19; 701/20; 246/2 R

(58) Field of Classification Search ..... 701/19, 701/20; 246/1 R, 2 R, 3, 122 R; 105/26.05
See application file for complete search history.

(56) References Cited

U.S. PATENT DOCUMENTS

| | | | | |
|---|---|---|---|---|
| 5,437,422 | A | 8/1995 | Newman | |
| 5,757,291 | A * | 5/1998 | Kull | 340/988 |
| 5,969,643 | A * | 10/1999 | Curtis | 340/988 |
| 6,125,311 | A * | 9/2000 | Lo | 701/29 |
| 6,580,976 | B1 | 6/2003 | Belcea | |

FOREIGN PATENT DOCUMENTS

| | | |
|---|---|---|
| EP | 958 987 A2 | 11/1999 |
| GB | 2 248 512 A | 4/1992 |

* cited by examiner

*Primary Examiner*—Yonel Beaulieu
(74) *Attorney, Agent, or Firm*—Sughrue Mion, PLLC

(57) ABSTRACT

The invention relates to a method and apparatus for controlling trains, in which method and apparatus, the location and the speed of a train on the line are acquired. A location specification is generated as a function of the acquisition, so that a movement control magnitude is delivered for controlling movement of the train. In the invention, a braking distance for the preceding train and the control magnitude are computed on the basis of the location specification plus the computed braking distance. Application in particular to ERTMS/ETCS systems.

17 Claims, 2 Drawing Sheets

METHOD AND APPARATUS FOR CONTROLLING TRAINS, IN PARTICULAR A METHOD AND APPARATUS OF THE ERTMS TYPE

BACKGROUND OF THE INVENTION

A field of application of the invention relates to controlling trains and providing assistance in driving trains, such as very high speed trains, regional trains, suburban trains, subway trains, trams, or the like. Such trains can be driven by a human on board, or automatically.

The invention seeks typically but not exclusively to implement the European Rail Traffic Management System/European Train Control System (ERTMS/ETCS), referred to below as "the ERTMS". This system aims to establish an international standard for systems for automatically controlling trains and, in particular aims to make cross-boarder traffic interoperable, and to make train control systems interoperable from one country to another and to make it possible to increase the density of train traffic on the same track with an optimum and uniform level of safety.

One of the ways of increasing the density of the traffic on the same line consists in reducing the distance between successive trains.

Thus, the ERTMS allocates to each train a location specification specifying a location to which the train is permitted to run on the line, it being necessary for the tail of the preceding train to be situated in front of that location.

OBJECTS AND SUMMARY OF THE INVENTION

An object of the invention is to improve further the density of train traffic on the same line.

To this end, the invention provides firstly apparatus for controlling trains, said apparatus including:

means for acquiring the location and the speed of at least one train on a line on which trains run, which means are connected to a computing unit including a first module suitable for acting, as a function of at least the acquired location and speed, to compute a location specification specifying a location which is situated downstream from the acquired location and to which the train is authorized to run with a target speed at said location specification;

a computing member for using a specified computation rule to compute a movement control magnitude for controlling movement of the train as a function of at least the location specification delivered by the computing first module;

said apparatus further including acquisition means for acquiring at least the speed of the preceding train on the track on which trains run, which means are also connected to means for recording the acquired speed, and the computing unit further includes a second module for acting as a function of at least the recorded speed of the preceding train and of a deceleration rate specified for the preceding train and greater than or equal to, in absolute terms, the absolute value of a service deceleration rate for said preceding train, to determine a braking distance value for the preceding train, the computing member being organized to deliver a movement control magnitude for the following train in compliance with the specified computation rule applied to said location specification delivered by the computing unit and to which the braking distance value delivered by the determination second module is added.

By means of the invention, the spacing distance between successive trains is reduced, while also complying with the safety distance between them. The higher the speed of the preceding train, the more the distance from the following train to the preceding train can be reduced relative to the location specification.

It is thus possible, for the same speed, to increase the density of traffic on the same line by about 10% to 20%.

According to other characteristics of the invention:

- the apparatus also includes means for signaling information to the following train in response to the train movement control magnitude delivered by the computing member;
- the apparatus further includes means for executing orders for the following train, corresponding to the train movement control magnitude delivered by the computing member;
- the computing unit includes an adder module receiving at a first input the location specification delivered by the computing first module and at a second input the braking distance value delivered by the determination second module, and delivering at its output a value equal to the sum of the value present at the first input plus the value present at the second input, the output of the subtracter module being connected to the input of the computing member delivering at its output said control magnitude computed using said specified computation rule applied to the value present at its input; and
- the acquisition means, the first module for computing the location specification, and the member for computing the control magnitude are of the ERTMS/ETCS type.

In order to implement an ERTMS system of level 1, the acquisition means and the computing unit are, according to a characteristic of the invention, situated in transponders or "balises" distributed along the line on which trains run, and suitable for transmitting the location specification to readers provided on board the trains, as the reader goes past or over the balise, and the computing member is situated on board the following train and is connected to said reader.

In order to implement an ERTMS system of level 2, the acquisition means, according to a characteristic of the invention, include location balises distributed along the line on which trains run, and suitable for being read by a reader provided on board the following train, means being provided for re-transmitting the acquired location and the acquired speed via a radio link to a radio center connected to the line on which trains run, the computing unit being provided in the radio center and being suitable for re-transmitting the location specification minus said braking distance value to the computing member situated on board the following train via a radio link.

According to another characteristic of the invention, independent of the above-described characteristics and that can be protected independently therefrom, wireless telecommunications means are provided on the preceding train and on the following train at least so that the preceding train transmits its acquired speed to the following train.

According to other characteristics of the invention:

- the service deceleration rate for the preceding train is equal to −0.6 meters per second per second ($m/s^2$);
- the deceleration rate specified for the preceding train is greater than or equal to, in absolute terms, the absolute value for an emergency deceleration rate for the preceding train, which absolute value is greater than the absolute value of the service deceleration rate for the preceding train; and the emergency deceleration rate for the preceding train is equal to $-2$ m/s$^2$.

The invention provides secondly a method of controlling trains, in which:

the location and the speed of at least one train on a line on which trains run are acquired;

as a function of at least the acquired location and speed, a location specification specifying a location which is situated downstream from the acquired location and to which the train is authorized to run with a target speed at said location specification is computed;

using a specified computation rule, a movement control magnitude for controlling movement of the train is computed as a function of at least the computed location specification;

wherein:

the speed of the preceding train on the track on which trains run is also acquired and recorded; and as a function of at least the recorded speed of the preceding train and of a deceleration rate specified for the preceding train and greater than or equal to, in absolute terms, the absolute value of a service deceleration rate for said preceding train, a braking distance value for the preceding train is determined;

said computation rule being applied to said computed specification location to which the determined braking distance value is added, in order to compute said train movement control magnitude.

According to other characteristics of the invention:

information is signaled to the following train in response to the computed train movement control magnitude; and/or an order is executed for the following train that corresponds to the computed train movement control magnitude.

According to another characteristic of the invention, independent of the above-described characteristics, and that can be protected independently therefrom, the acquired speed of the preceding train is transmitted via a wireless telecommunications link directly from the preceding train to the following train.

In order to implement an ERTMS system of level 1, the speed and location acquisition, and the computing of the location specification, of the control magnitude, and of the braking distance value of the preceding train are performed on board the following train.

In order to implement an ERTMS system of level 2, according to a characteristic of the invention, the location and speed acquisition is performed on board the following train, the acquired location and speed are transmitted from the following train via a wireless radio telecommunications link to a radio center in which the location specification is computed, from which said braking distance value is subtracted, and which is then re-transmitted by the telecommunications link to the following train, on which said train movement control magnitude is computed, the speed of the preceding train being acquired on board said preceding train and being transmitted via another radio telecommunications link to the radio center, in which the braking distance value is calculated.

BRIEF DESCRIPTION OF THE DRAWINGS

The invention will be better understood on reading the following description made with reference to the accompanying drawings which are given merely by way of non-limiting example, and in which.

MORE DETAILED DESCRIPTION

The ERTMS is defined in Document "ERTMS/ETCS-Class 1, Systems Requirements Specification, Subset-026-1, Subset 026-2, Subset 026-3" et seq., available on the Internet at www.unife.org/docs/ertms. A glossary is also available at that address. Those documents, to which reference is made, are the property of Adtranz, Alcatel, Alstom, Ansaldo Signal, Invensys Rail, and Siemens. The documents to which reference is made herein are those bearing the date of Dec. 22, 1999 in their Version 2.0.0.

Chapter 2of the above-mentioned document (Subset-026-2) subdivides the ERTMS into on-board subsystems provided on board each train, and trackside subsystems provided in a manner fixed relative to the track or to the line on which the trains run.

Figure 1:
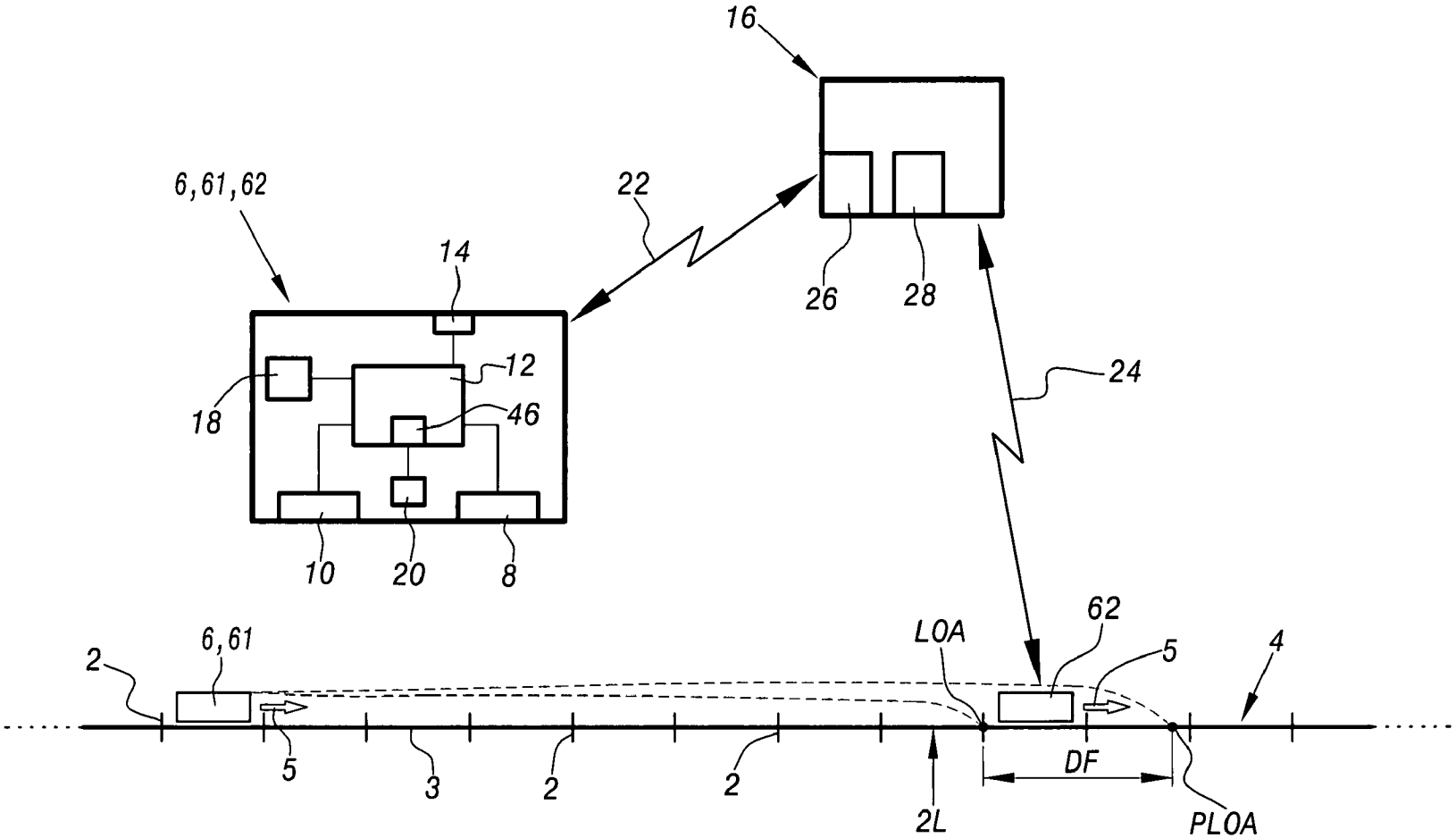
FIG. 1 is a diagrammatic overall view of a system of the ERTMS type.

Thus, by way of example shown in FIG. 1, the ERTMS of application level 2, as described in the above-described document in Chapter 2.6.6, includes transponders or "balises" 2 distributed uniformly along the line 4 on which the trains run and referred to as "Eurobalises".

A balise reader 8 and a detector 10 for detecting speed and distance traveled by the train are situated on board the train 6. The detector can, for example, comprise a radar and a phonic wheel, as is known. As the train 6 moves along the track 4, its reader 8 goes successively over or past each balise 2.

Each balise 2 comprises a radio transmitter transmitting balise identification information via a wireless radio link to a radio receiver provided in the reader 8 as the train goes over or past said balise. The information obtained by the reader 8 and by the detector 10 is delivered to a central computer 12 situated on board the train 6 and referred to as a "European Vital Computer" (EVC). The balises 2 make it possible to locate the train whenever said train has passed through or cleared a section lying between two balises.

The reader 8 makes it possible to reference the position of the train 6 each time it goes past or over a balise 2, and thus to acquire a location for the train 6. The location of, the speed of, and other information about the train 6 is transmitted by the computer 12 via a transceiver 14 provided on board the train 6 and via a wireless radio telecommunications link 22 to a trackside radio center 16 fixed relative to the track 4. For example, the radio center 16 implements the Global System for Mobile Communications-Railways (GSM-R) for its links.

The radio center 16 is referred to as the "Radio Block Center" (RBC) and is defined for a region, the train 6 communicating with another RBC when it finds itself in another region.

In response to the information received from the train 6, the radio center 16 sends back to it a location specification specifying a location downstream of the last balise 2 that the train went past or over. The location specification corresponds to a location on the track 4 to which the train is authorized to move with a determined target speed at said location specification.

When the computer 12 receives a location specification, said computer 12 computes a movement control magnitude GC for the train 6 using a specified computation rule.

For example, in the ERTMS, the location specification corresponds to a Movement Authority as defined in chapter 3.8 of the above-mentioned document. For example, the movement authority is the End of Authority or the End of Movement Authority (EOA) defined as being the location to which the train is permitted to proceed and where target speed,is equal to zero.

The target is defined as the location where the train speed should be below the given target speed.

The location specification can also correspond to the Limit of Authority (LOA) defined as being the place which the train is not authorized to pass and where target speed is not equal to zero.

The ERTMS also defines a Danger Point which is the location beyond the EOA that can be reached by the front of the train without creating a hazardous situation, a safety distance thus being defined between the EOA and the first possible danger point. The movement authority (EOA or LOA) must not ever exceed the rear end of the preceding train on the line 4.

The movement control magnitude GC generated by the module 12 is sent to the module 18 on board the train 6, which module 18 can be a device for presenting information to a human operator of the train 6 e.g. visually, audibly, or in some other way, or to automatic order execution means 20 for executing an automatic order for controlling the train 6, which order corresponds to said movement control magnitude GC. Such execution means 20 are provided on an automatically driven train with no human operator on board, and they are also provided on a train 6 driven by a human operator. The execution means can be an emergency brake actuator and/or a service brake actuator. The movement control magnitude GC can be in the form of a speed profile that the train 6 must adopt until it reaches its location specification, the movement control magnitude GC being computed by the computer 12.

For example, on a high speed line (HSL), the balises 2 subdivide the track into sections 3 of 1500 meters. For a train traveling at 300 kilometers per hour (km/h), the Limit of Authority specification is about 7 sections ahead, as shown in FIG. 1. For a 160 km/h line, each of the sections are 2100 meters long, and the LOA specification is about 3 sections ahead of the train.

In accordance with the invention, the speed of the train 62 preceding the following train 61 on the track 4 in the direction 5 in which the trains 62, 61 are running on it is taken into account. The train 62 is equipped with the same above-described system as the system with which the train 61 is equipped, and it also communicates in both-way manner via a wireless radio telecommunications link 24 with the radio center 16. Means for recording the acquired speed of the preceding train 62 on the track 4 are provided on board the train 62, e.g. in its computer 12, and in the radio center 16, the speed acquired by the detector 10 on board the train 62 being transmitted via the radio link 24 to the radio center 16.

For the RBC computer of the ERTMS of level 2, the LOA specification is given on the basis of the location given by the following train 61, including its speed, and on the basis of section clear information indicating that the section 2L preceding the preceding train 62 is clear. The section clear information is given by another computer that is stationary relative to the track, referred to as an "interlocking station", communicating with the RBC computer. The RBC computer sends the movement authority extension or Pseudo Limit of Authority (PLOA) described below with track description information corresponding to the extension (profile, speed restrictions, etc.).

Figure 2:
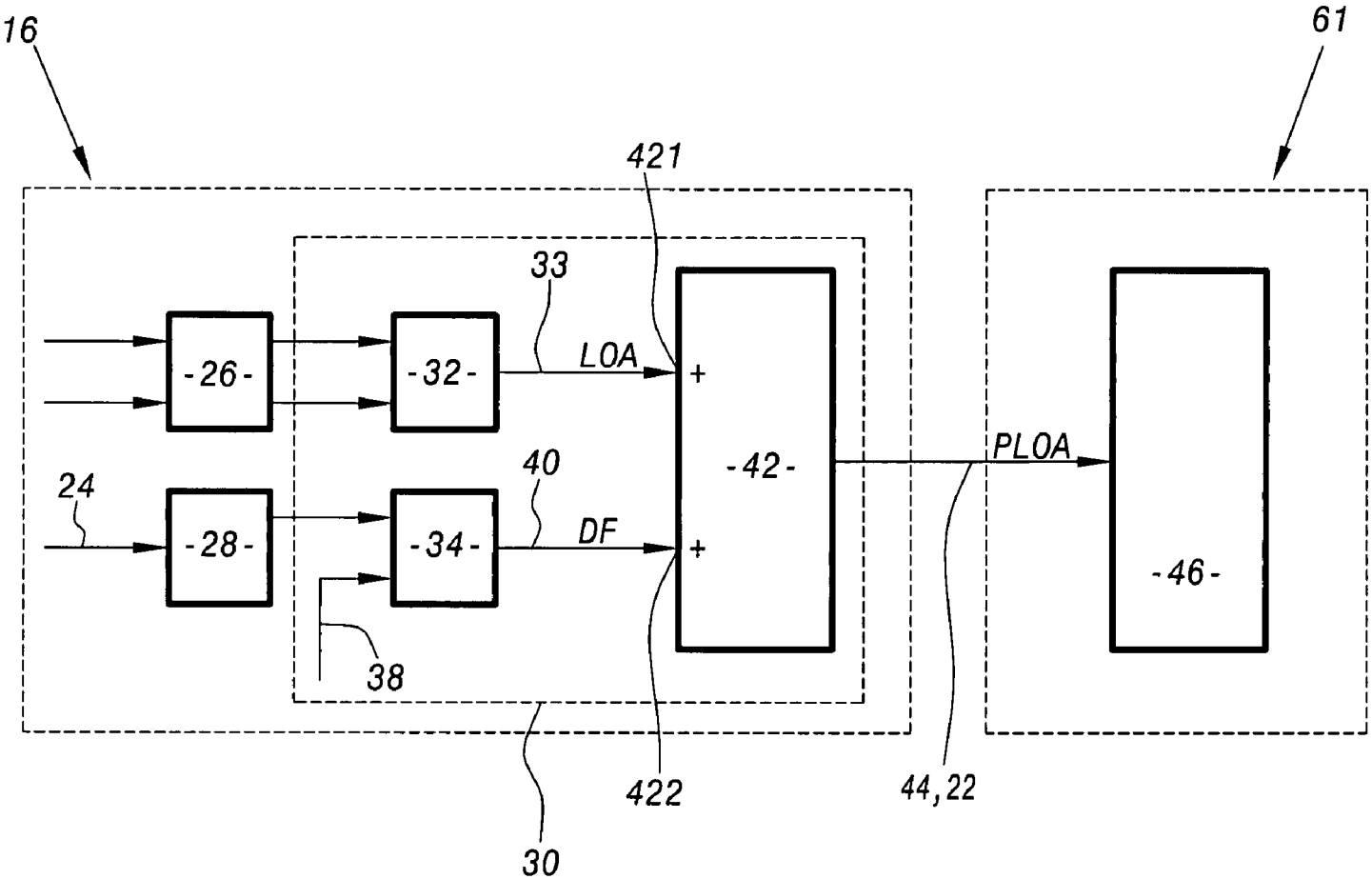
FIG. 2 is a modular block diagram of the apparatus of the invention.

FIG. 2 shows that the radio center 16 has a memory 26 for storing the location and the speed acquired for the following train 61, as transmitted via the radio link 22. In addition, the radio center 16 has a memory 28 for storing the acquired speed transmitted via the radio link 24 from the preceding train 62.

A computer unit 30 for computing the PLOA is provided in the radio center 16 and is implemented by any technical means such as, for example, an electronic computer. The computer unit 30 includes a computing first module 32 for computing said LOA as a function of at least the speed and the location recorded in the memory 26, and a determination second module 34. The determination module 34 has a first input 36 for the acquired speed of the preceding train, as recorded in the memory 28, and a second input 38 for a deceleration rate or value. The determination module 34 determines, at least as a function of the data present at its first and second inputs 36 and 38, a braking distance value DF for the braking distance of the preceding train 62. The deceleration rate or value present at the second input 38 is greater than or equal to, in absolute terms, the absolute value of a service deceleration rate for the preceding train 62.

The service deceleration rate or value corresponds to a service braking distance for the preceding train 62, defined in the ERTMS as being the distance in which a train is capable of stopping, from a given speed, at such a deceleration for a passenger train that the passengers do not suffer discomfort or alarm or at an equivalent deceleration in the case of non-passenger trains. Deceleration data is defined as being data that relates a braking demand to the rate at which a train will slow down. For example, the service deceleration rate or value is equal to $-0.6\ m/s^2$.

The deceleration rate or value specified on the second input 38 is, for example, greater than or equal to, in absolute terms, the absolute value of the deceleration rate or value in the event of emergency braking, which is itself greater than the absolute value of the service deceleration rate or value, and equal to $2\ m/s^2$. The emergency braking distance is defined as the distance in which a train is capable of stooping in an emergency and as being dependent upon train speed, train type, braking characteristics, train weight and the gradient of the line 4.

The real maximum deceleration rate for rolling stock of the high speed train type is $-1.1\ m/s^2$ under precise conditions (gradient, wind, etc.). The specified deceleration rate is, for example, greater than the real maximum declaration rate. The specified deceleration rate is, for example, greater in absolute terms than $1.25\ m/s^2$. The specified deceleration rate is, for example, $-1.5\ m/s^2$.

The LOA output 33 of the computing module 32 is connected to an add input 421 of an adder module 42, while the braking distance value DF output 40 is connected to another add input 422 of the adder module 42. The adder module 42 forms at its output 44 the PLOA equal to the LOA present at the add input 421 plus the braking distance value DF present at the other add input 422. Hence:

$$PLOA=LOA+DF$$

The PLOA present at the output 44 of the subtracter module 42 is connected to the radio transmitter of the radio center 16 so as to be transmitted via the wireless radio link 22 to the transceiver 14 of the following train 61, and then to the computer 12 on board said following train. The computing module 46 of the following train 62 then applies the rule for computing the movement order magnitude GC for the following train to the PLOA received from the radio center 16 and present at the output 44 of the subtracter module 42.

Thus, the PLOA is ahead of the LOA and can even be ahead of the preceding train 62. Therefore, the following train 61 can be closer to the preceding train 62, which makes it possible for a higher number of trains to run on the line 4 per unit of time, or for longer trains to run, or for the trains to run faster. It is thus possible to increase the density of traffic on the track 4 and thus to decrease the operating costs.

Naturally, the invention is also applicable to any other architecture, e.g. also to an ERTMS of application level 1, as defined in chapter 2.6.5 of the above-mentioned document, or to an ERTMS of application level 3, as defined in Chapter 2.6.7 of the above-mentioned document.

In an ERTMS of application level 1, no radio center 16 is provided and it is the balises 2 that transmit the location specifications directly to the train 6, 61 as it goes over or past them, via the reader 8. In which case, the elements described with reference to FIG. 2 are all provided in the computer 12 on board the following train 61.

In the ERTMS of application level 3, the location of the preceding train is used by the RBC to determine the section cleared by the preceding train, unlike the ERTMS of level 2, in which clearing of the section is given by an interlocking station.

Naturally, the invention is not limited to the ERTMS/ETCS and it can be applied to any other system.

Thus, in the above-described ERTMS systems or in any other system, wireless telecommunications means can be provided on the preceding train and on the following train, at least so that the preceding train transmits to the following train its location, and its speed as acquired by acquisition means provided for it. It is thus possible save the time necessary for setting up a plurality of calls going through the radio center and described with reference to FIGS. 1 and 2, thereby making it possible to shorten the location specification for the following train 61. In which case, the preceding train transmits to the following train its location relative to a balise situated at the end of a section, and its speed. Since it has received the track description information (profile, speed restrictions, balises to be encountered) from the RBC computer, the following train is capable of determining the location of the preceding train by means of the identity of the balise delivered with the location, which identity is unique in the world. Since it knows the balise and the speed of the preceding train, the following train computes the distance DF to be added to the balise in order to obtain the PLOA, the balise embodying the LOA. Sending track description information from the RBC computer to the following train is asynchronous relative to the real location of the preceding train, and must merely be performed previously.

Optionally, this characteristic can be combined with the characteristic of adding the braking distance to the LOA, in order to enable the location specification to be shortened still further, thereby making it possible to reduce the distance between two trains one behind the other.

What is claimed is:

1. Apparatus for controlling trains, said apparatus including:

means for acquiring the location and the speed of at least one train on a line on which trains run, which means are connected to a computing unit including a first module suitable for acting, as a function of at least the acquired location and speed, to compute a location specification (LOA) specifying a location which is situated downstream from the acquired location and to which the train is authorized to run with a target speed (TS) at said location specification (LOA);

a computing member for using a specified computation rule to compute a movement control magnitude (GC) for controlling movement of the train as a function of at least the location specification (LOA) delivered by the computing first module;

said apparatus further including acquisition means for acquiring at least the speed of the preceding train on the track on which trains run, which means are also connected to means for recording the acquired speed, and the computing unit further includes a second module for acting as a function of at least the recorded speed of the preceding train and of a deceleration rate specified for the preceding train and greater than or equal to, in absolute terms, the absolute value of a service deceleration rate for said preceding train, to determine a braking distance value (DF) for the preceding train, the computing member being organized to deliver a movement control magnitude (GC) for the following train in compliance with the specified computation rule applied to said location specification (LOA) delivered by the computing unit and to which the braking distance value (DF) delivered by the determination second module is added.

2. Apparatus according to claim 1, further including means for signaling information to the following train in response to the train movement control magnitude delivered by the computing member.

3. Apparatus according to claim 1, further including means for executing orders for the following train, corresponding to the train movement control magnitude (GC) delivered by the computing member.

4. Apparatus according to claim 1, wherein the computing unit includes an adder module receiving at a first input the location specification (LOA) delivered by the computing first module and at a second input the braking distance value (DF) delivered by the determination second module, and delivering at its output a value equal to the sum of the value present at the first input plus the value present at the second input, the output of the subtracter module being connected to the input of the computing member delivering at. its output said control magnitude (GC) computed using said specified computation rule applied to the value present at its input.

5. Apparatus according to claim 1, wherein the acquisition means, the first module for computing the location specification (LOA), and the member for computing the control magnitude (GC) are of the ERTMS/ETCS type.

6. Apparatus according to claim 5, wherein the acquisition means and the computing unit are situated in transponders or "balises" distributed along the line on which trains run, and suitable for transmitting the location specification (LOA) to readers provided on board the trains, as the reader goes past or over the balise, and the computing member is situated on board the following train and is connected to said reader.

7. Apparatus according to claim 5, wherein the acquisition means include location balises distributed along the line on which trains run, and suitable for being read by a reader provided on board the following train, means being provided for re-transmitting the acquired location and the acquired speed via a radio link to a radio center connected to the line on which trains run, the computing unit being provided in the radio center and being suitable for re-transmitting the location specification (LOA) minus said braking distance value (DF) to the computing member situated on board the following train via a radio link.

8. Apparatus according to claim 1, wherein wireless telecommunications means are provided on the preceding train and on the following train at least so that the preceding train transmits its acquired speed to the following train.

9. Apparatus according to claim 1, wherein the service deceleration rate for the preceding train is equal to −0.6 $m/s^2$.

10. Apparatus according to claim 1, wherein the deceleration rate specified for the preceding train is greater than or equal to, in absolute terms, the absolute value for an emergency deceleration rate for the preceding train, which absolute value is greater than the absolute value of the service deceleration rate for the preceding train.

11. Apparatus according to claim 10, wherein the emergency deceleration rate for the preceding train is equal to −2 $m/s^2$.

12. A method of controlling trains, in which:

the location and the speed of at least one train on a line on which trains run are acquired;

as a function of at least the acquired location and speed, a location specification (LOA) specifying a location which is situated downstream from the acquired location and to which the train is authorized to run with a target speed (TS) at said location specification (LOA) is computed;

using a specified computation rule, a movement control magnitude (GC) for controlling movement of the train is computed as a function of at least the computed location specification (LOA);

wherein:

the speed of the preceding train on the track on which trains run is also acquired and recorded; and as a function of at least the recorded speed of the preceding train and of a deceleration rate specified for the preceding train and greater than or equal to, in absolute terms, the absolute value of a service deceleration rate for said preceding train, a braking distance value (DF) for the preceding train is determined;

said computation rule being applied to said computed specification location (LOA) to which the determined braking distance value (DF) is added, in order to compute said train movement control magnitude (GC).

13. A method according to claim 12, wherein information is signaled to the following train in response to the computed train movement control magnitude (GC).

14. A method according to claim 12, wherein an order is executed for the following train that corresponds to the computed train movement control magnitude (GC).

15. A method according to claim 12, wherein the acquired speed of the preceding train is transmitted via a wireless telecommunications link directly from the preceding train to the following train.

16. A method according to claim 12, wherein the speed and location acquisition, and the computing of the location specification (LOA), of the control magnitude (GC), and of the braking distance value (DF) of the preceding train are performed on board the following train.

17. A method according to claim 12, wherein the location and speed acquisition is performed on board the following train, the acquired location and speed are transmitted from the following train via a wireless radio telecommunications link to a radio center in which the location specification (LOA) is computed, from which said braking distance value (DF) is subtracted, and which is then re-transmitted by the telecommunications link to the following train, on which said train movement control magnitude (GC) is computed, the speed of the preceding train being acquired on board said preceding train and being transmitted via another radio telecommunications link to the radio center, in which the braking distance value (DF) is calculated.

* * * * *